US005941161A

United States Patent [19]

Kimura et al.

[11] Patent Number: 5,941,161

[45] Date of Patent: Aug. 24, 1999

[54] PISTON TYPE COMPRESSOR

[75] Inventors: Kazuya Kimura; Masaki Ota; Hiroaki Kayukawa, all of Kariya, Japan

[73] Assignee: Kabushiki Kaisha Toyoda Jidoshokki Seisakusho, Aichi-ken, Japan

[21] Appl. No.: 08/986,263

[22] Filed: Dec. 5, 1997

[30] Foreign Application Priority Data

Dec. 6, 1996 [JP] Japan ..... 8-326840

[51] Int. Cl.[6] ..... F04B 27/12; F01B 31/00

[52] U.S. Cl. ..... 92/155; 92/71; 92/175

[58] Field of Search ..... 92/71, 175, 172, 92/155

[56] References Cited

U.S. PATENT DOCUMENTS 4,519,119 5/1985 Nakayama et al. ..... 92/175
4,701,110 10/1987 Iijima ..... 92/71
5,630,353 5/1997 Mittlefehldt et al. ..... 92/172
5,630,355 5/1997 Ikeda et al. ..... 92/71
5,813,315 9/1998 Kristensen et al. ..... 92/71

*Primary Examiner*—Sheldon J. Richter
*Attorney, Agent, or Firm*—Morgan & Finnegan, L.L.P.

[57] ABSTRACT

A compressor having a cylinder bores and pistons are disclosed. Each piston moves in the associated cylinder to compress gas therein. Each piston slides on an inner peripheral wall of an associated cylinder to seal a compression chamber. Each piston includes an outer peripheral surface and cavities. The outer peripheral surface has a seal to seal the cylinder and a pressure receiving surface to receive reaction forces from the wall of the cylinder. A low friction layer is formed on the pressure receiving surface. The layer facilitates the sliding movement of the piston with respect to the cylinder.

23 Claims, 4 Drawing Sheets

PISTON TYPE COMPRESSOR

BACKGROUND OF THE INVENTION

1. Field of the Invention

The present invention relates to compressors that are used in vehicle air conditioners. More particularly, the present invention pertains to sliding structure of pistons in a compressor.

2. Description of the Related Art

A typical compressor used in a vehicle has the following construction. The compressor includes a housing, and a cylinder block constitutes a part of the housing. A crank chamber is defined in the housing. A drive shaft is rotatably supported in the crank chamber. The cylinder block has cylinder bores formed therein. A piston is reciprocally housed in each cylinder bore. A cam plate is supported on and rotates integrally with the drive shaft in the crank chamber. Each piston is connected to the cam plate by means of shoes. Rotation of the drive shaft is converted into linear reciprocation of the pistons by the cam plate. Refrigerant gas in the cylinder bores is compressed by the reciprocation.

In such a compressor, the inertial force acting on each piston becomes greatest when the piston shifts from the suction stroke to the compression stroke. The inertial force of the piston acts on the cam plate. On the other hand, the piston receives a reaction force from the cam plate. The reaction force includes a lateral component that is directed radially outward from the axis of the cam plate. This component presses a part of each piston head against the inner wall of the associated cylinder bore. This lateral component of the reaction force will be referred to as the lateral force. The inertial force of the pistons increases as the weight of the piston is increased. An increased inertial force of the pistons results in a greater lateral force acting on each piston.

However, the housing, which includes the cylinder block, and the pistons are made of aluminum alloy, which is light, for reducing the weight of the compressor. Therefore, when a piston is reciprocating in the associated cylinder bore, the above described lateral force prevents the piston from smoothly sliding with respect to the cylinder bore.

SUMMARY OF THE INVENTION

Accordingly, it is an objective of the present invention to provide a compressor that reduces the magnitude of lateral forces acting on piston heads and reduces the weight of the pistons. Another objective of the present invention is to reduce frictional resistance between pistons and cylinder bores thereby allowing the pistons to smoothly reciprocate in the cylinder bores.

To achieve the foregoing and other objectives and in accordance with the purpose of the present invention, an improved compressor is provided. The compressor includes a bore, a compression chamber defined within the bore and a piston. The piston moves within the bore to compress gas in the compression chamber and seals the compression chamber. The piston includes a cavity, a peripheral surface and an element for smoothing the movement of the piston. The cavity reduces the weight of the piston. The peripheral surface has a first surface to form a compression chamber seal and a second surface to a receive a lateral reaction force caused by operation of the compressor. The smoothing element is located between the second surface of the piston and the bore.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor of a single-headed piston type according to a first embodiment of the present invention will be described with reference to FIGS. 1 to 3.

Figure 1:
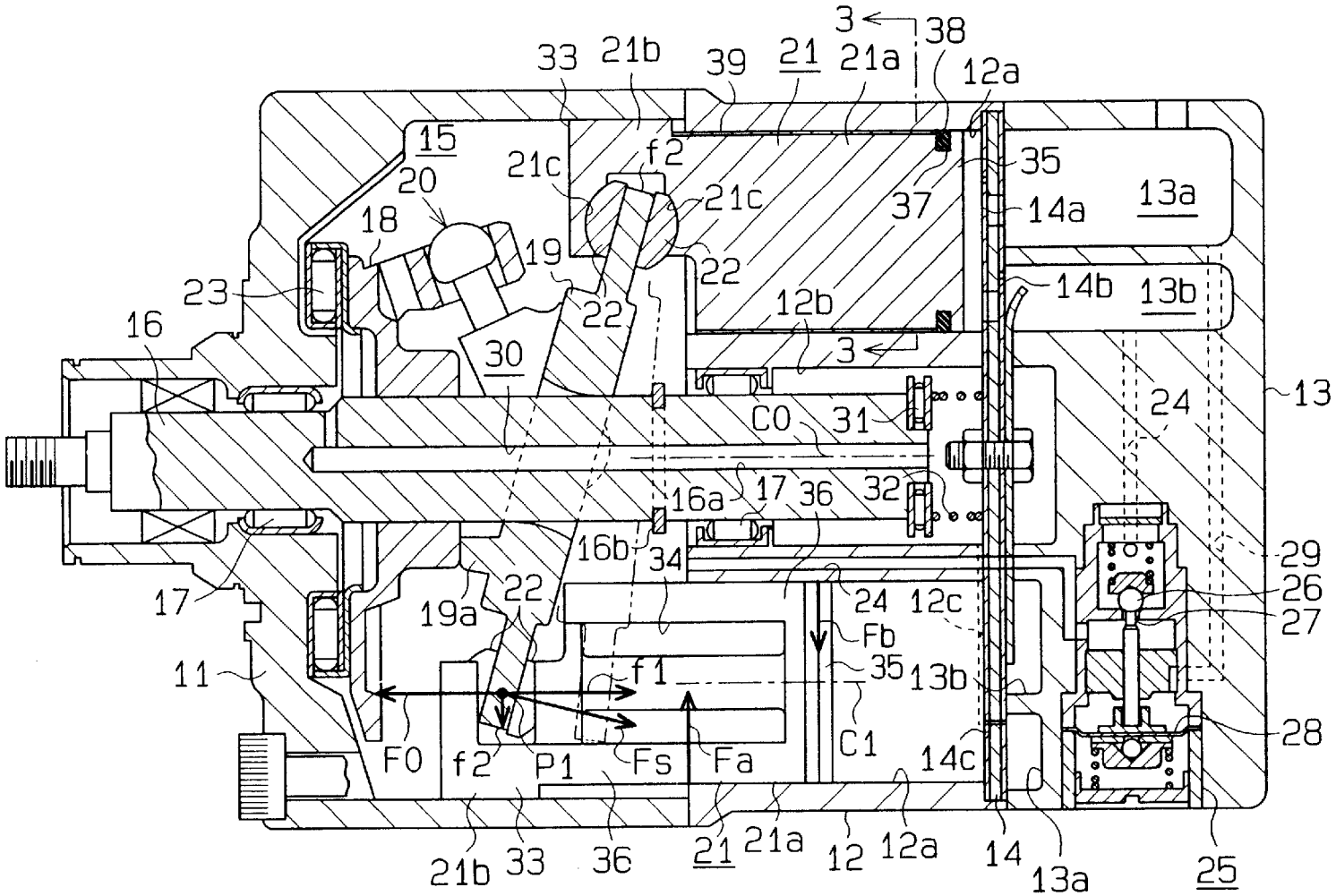
FIG. 1 is a cross-sectional view illustrating a variable displacement compressor according to a first embodiment of the present invention.

As shown in FIG. 1, a front housing 11 is coupled to the front end of a cylinder block 12. A rear housing 13 is coupled to the rear end of the cylinder block 12. The front housing 11, the cylinder block 12, and the rear housing 13 constitute a housing of the compressor. The front housing 11, the cylinder block 12 and the rear housing 13 are made of, for example, aluminum alloy.

A suction chamber 13*a* and a discharge chamber 13*b* are defined in the rear housing 13. A valve plate 14 having suction flaps 14a and discharge flaps 14*b* is arranged between the rear housing 13 and the cylinder block 12. A crank chamber 15 is defined in the front housing 11 in front of the cylinder block 12. A drive shaft 16 extends through the crank chamber 15, the front housing 11 and the cylinder block 12. A pair of radial bearings 17 rotatably support the drive shaft 16.

A lug plate 18 is fixed to the drive shaft 16. A swash plate 19, which functions as a cam plate, is fitted to the drive shaft 16 in the crank chamber 15. The swash plate 19 is supported so that it is slidable in the axial direction of the drive shaft 16 and inclinable with respect to the drive shaft 16. The swash plate 19 is connected to the lug plate 18 by means of a hinge mechanism 20. The hinge mechanism 20 guides the movement of the swash plate 19 in the axial direction of the drive shaft 16 and the inclination of the swash plate 19 with respect to the drive shaft 16. The hinge mechanism 20 also rotates the swash plate 19 integrally with the drive shaft 16.

A stopper 19*a* is provided on the front surface of the swash plate 19. The abutment of the stopper 19*a* against the lug plate 18 determines the maximum inclination position of the swash plate 19. A stopper ring 16*b* is provided on the drive shaft 16. The abutment of the swash plate 19 against the stopper ring 16*b* restricts further inclination of the swash plate 19 and thus determines the minimum inclination position of the swash plate 19.

Cylinder bores 12*a* extend through the cylinder block 12. A single-headed piston 21 is housed in each cylinder bore 12*a*. Each piston 21 is integrally molded with aluminum alloy and has a rear portion, or a head 21*a*, and a front portion, or a skirt 21*b*. The head 21*a* of each piston 21 is slidably accommodated in the associated cylinder bore 12*a*. The skirt 21*b* is provided with a slot facing the swash plate 19. A concave receiving surface 21*c* is defined in each of the opposing walls of the slot. Each receiving surface 21*c* receives the semispherical portion of a shoe 22. The periphery of the swash plate 19 is fitted into the slot of each piston skirt 21*b* and is slidably held between the flat portions of the associated pair of shoes 22. A thrust bearing 23 is arranged between the lug plate 18 and the front wall of the front housing 11. The front housing 11 receives the reaction force that acts on each piston 21 during compression of the gas by way of the shoes 22, the swash plate 19, the hinge mechanism 20, the lug plate 18, and the thrust bearing 23.

A pressurizing passage 24 extends through the cylinder block 12, the valve plate 14, and the rear housing 13 to connect the discharge chamber 13*b* with the crank chamber 15. A displacement control valve 25 is arranged in the rear housing 13 with the pressurizing passage 24 extending therethrough. The control valve 25 has a valve hole 27, a valve body 26 faced toward the valve hole 27, and a diaphragm 28 for adjusting the opened area of the valve hole 27. A pressure communicating passage 29 is provided to expose one side of the diaphragm 28 to the pressure (suction pressure Ps) of the suction chamber 13*a*. The diaphragm 28 moves the valve body 26 and adjusts the area of the valve hole 27 opened by the valve body 26 in accordance with the communicated suction pressure Ps.

The control valve 25 alters the amount of refrigerant gas flowing into the crank chamber 15 through the pressurizing passage 24 from the discharge chamber 13*b* and adjusts the pressure Pc of the crank chamber 15. Changes in the pressure Pc of the crank chamber 15 alter the difference between the pressure Pc of the crank chamber 15 acting on the bottom surface of each piston 21 (the left surface as viewed in FIG. 1) and the pressure of the associated cylinder bore 12*a* acting on the head surface of the piston 21 (the right surface as viewed in FIG. 1). The inclination of the swash plate 19 is altered in accordance with changes in the pressure difference. This, in turn, alters the stroke of the piston 21 and varies the displacement of the compressor.

A pressure relieving passage 30 connects the crank chamber 15 to the suction chamber 13*a*. The relieving passage 30 is constituted by an axial passage 16*a* extending through the center of the drive shaft 16, a retaining bore 12*b* defined in the center of the cylinder block 12, a pressure releasing groove 12*c* extending through the rear surface of the cylinder block 12, and a pressure releasing bore 14*c* extending through the valve plate 14. A radial inlet of the axial passage 16*a* is connected with the crank chamber 15 at the vicinity of the front radial bearing 17. A certain amount of the refrigerant gas in the crank chamber 15 is constantly drawn into the suction chamber 13*a* through the relieving passage 30.

A thrust bearing 31 and a coil spring 32 are arranged in the retaining bore 12*b* between the rear end of the drive shaft 16 and the valve plate 14.

Figure 3:
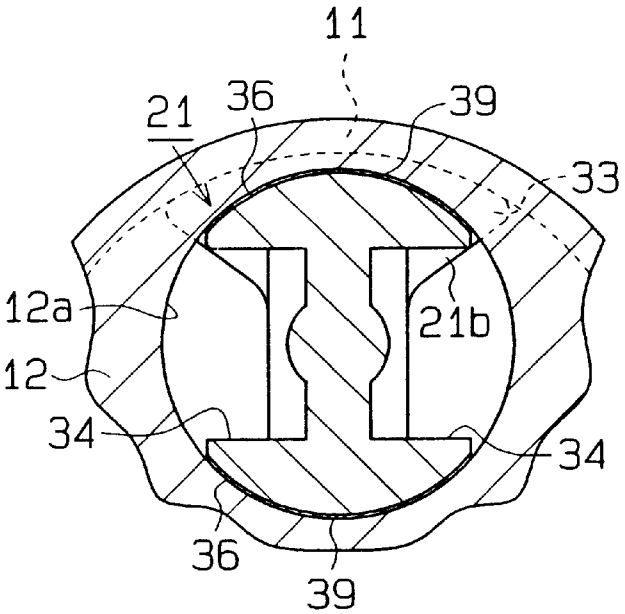
FIG. 3 is an enlarged partial cross-sectional view illustrating the piston of FIG. 2 taken along line 3—3 of FIG. 1.
Figure 2:
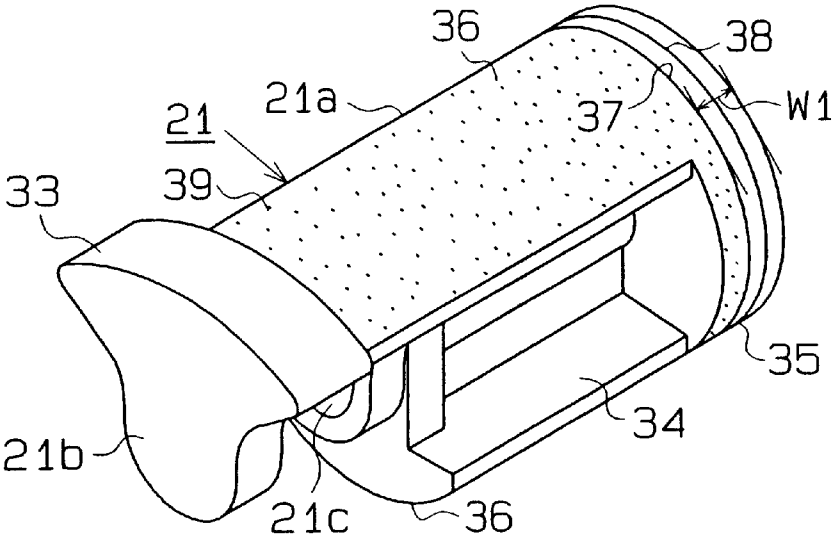
FIG. 2 is a perspective view illustrating a piston of the compressor shown in FIG. 1.

As shown in FIGS. 1 to 3, each piston 21 has a rotation restriction 33 defined at the end of the skirt 21*b*. The restriction 33 includes an arcuate surface that faces the inner wall of the front housing 11. The radius of curvature of the arcuate surface is substantially the same as that of the inner wall of the front housing 11. When the piston 21 moves reciprocally, the arcuate surface of the restriction 33 contacts the inner wall of the front housing 11. This prevents the piston 21 from rotating about its axis.

A pair of cavities 34 (only one is shown in FIG. 2) are symmetrically defined in the piston head 21*a*. The cavities 34 are angularly spaced apart by 180 degrees and extend in the longitudinal direction of the head 21*a*. A pair of pressure receiving surfaces 36 are defined on opposite sides of the cavities 34. The head 21*a* also includes a seal 35, which is formed continuously with the receiving surfaces 36, on the rear end of the pistons 21. The seal 35 is circularly defined about the head 21*a* and substantially the whole area of the seal 35 contacts the inner wall of the cylinder bore 12*a*. An annular groove 37 is formed in the periphery of the seal 35. A piston ring 38 is fitted in the groove 37.

When each piston 21 shifts from the suction stroke to the compression stroke, the inertial force of the piston 21 acts on the cam plate. On the other hand, the piston 21 receives a reaction force from the swash plate 19. The reaction force includes a lateral component that is directed radially outward from the axis of the swash plate 19. A reaction to this component, or a lateral force, is received by the pressure receiving surfaces 36 of the piston head 21*a*.

The cavities 34 are formed either when molding the piston 21 or by machining the molded piston 21. The cavities 34 reduce the weight of the piston 21. Since the piston ring 38 positively seals the space between the piston 21 and the cylinder bore 12*a*, the width W1 of the seal 35 can be minimized. This further reduces the weight of the piston 21.

A low friction layer 39 is formed on the pressure receiving surfaces 36. That is, the low friction layer 39 has a low coefficient of friction. The layer 39 is constituted by, for example, a coating of fluorocarbon resin having a certain thickness. The layer 39 reduces friction between the cylinder bore 12*a* and the piston 21.

The drive shaft 16 is rotated by an external drive means such as an automobile engine. The swash plate 19 is integrally rotated with the drive shaft 16 by means of the lug plate 18 and the hinge mechanism 20. The rotation of the swash plate 19 is converted to linear reciprocation of each piston 21 in the associated cylinder bore 12*a* by the shoes 22. The reciprocation of the piston 21 draws the refrigerant gas in the suction chamber 13*a* into the cylinder bore 12*a* through the associated suction flap 14*a*. When the refrigerant gas in the cylinder bore 12*a* is compressed to a predetermined pressure, the gas is discharged into the discharge chamber 13*b* through the associated discharge flap 14*b*.

If the ambient temperature is high and the cooling load is great, high suction pressure Ps in the suction chamber 13*a* acts on the diaphragm 28 of the control valve 25 causing the valve body 26 to close the valve hole 27. This closes the pressurizing passage 24 and stops the flow of high pressurized refrigerant gas from the discharge chamber 13*b* to the crank chamber 15. In this state, the refrigerant gas in the crank chamber 15 is released into the suction chamber 13*a* through the relieving passage 30. This decreases the pressure Pc of the crank chamber 15. Thus, the difference between the pressure Pc in the crank chamber 15 and the pressure in the cylinder bores 12*a* becomes small. As a result, the swash plate 19 is moved to the maximum inclination position, as shown by the solid lines in FIG. 1, and the stroke of the piston 21 becomes maximum. In this state the displacement of the compressor is maximum.

If the ambient temperature is low and the cooling load is low, low suction pressure Ps in the suction chamber 13*a* acts on the diaphragm 28 of the control valve 25 causing the valve body 26 to open the valve hole 27. This communicates the high pressurized refrigerant gas in the discharge chamber 13*b* to the crank chamber 15 through the pressurizing passage 24 and increases the pressure Pc of the crank chamber 15. Thus, the difference between the pressure Pc in the crank chamber 15 and the pressure in the cylinder bores 12*a* becomes large. As a result, the swash plate 19 moves toward the minimum inclination position, as shown by the two-dot chain line in FIG. 1, and decreases the stroke of the piston 21. In this state the displacement of the compressor becomes small.

In this manner, the displacement control valve 25 adjusts the opening amount of the pressurizing passage 24 thereby changing the pressure Pc in the crank chamber 15. Changes in the pressure Pc of the crank chamber 15 alter the inclination of the swash plate 19.

The lateral forces applied to each piston 21 during operation of the compressor will now be described.

Lateral force refers to a reaction force applied to the piston 21 by the wall of the associated cylinder bore 12*a* when the peripheral surface of the piston 21 presses against the wall of the cylinder bore 12*a*. For example, when the piston 21 shifts from the suction stroke to the compression stroke, that is, when the piston 21 is in the vicinity of the bottom dead center, like the lower piston 21 shown in FIG. 1, the inertial force acting on the piston 21 becomes maximum. In FIG. 1, the inertial force acting on the piston 21 is denoted by F0. The inertial force F0 of the piston 21 is applied to the swash plate 19. Accordingly, the piston 21 receives reaction force Fs, which is associated with the inertial force F0, from the inclined swash plate 19. The reaction force Fs is divided into component force f1, which acts in the axial direction of the piston 21, and component force f2, which acts in the radial direction of the piston 21. The component force f2 inclines the skirt 21*b* of the piston 21 in the direction of the component force f2.

Therefore, the pressure receiving surface 36 is pressed by the wall of the cylinder bore 12*a* by a force corresponding to the component force f2. In other words, the surface 36 receives reaction force (lateral force) Fa associated with the component force f2, from the wall of the cylinder bore 12*a*. Furthermore, the peripheral surface at the rear end of the piston head 21*a* receives a reaction force (lateral force) Fb, which is associated with the component force f2, from the wall of the cylinder bore 12*a*.

In this compressor, the cavities 34 are formed in the piston 21 apart from the area corresponding to the seal 35 and the pressure receiving surfaces 36. Further, the low friction layer 39 is formed on the seal 35 and the receiving surfaces 36. Thus, the weight of each piston 21 is reduced and frictional resistance between the piston 21 and the cylinder bore 12*a* is lowered. This allows the piston 21 to smoothly reciprocate in the cylinder bore 12*a*.

The lateral force Fa acts on a part of the head 21*a* that contacts the front end of the cylinder bore 12*a*. In other words, the part of the head 21*a* on which the force Fa acts is spaced as far as possible from the rear end of the piston 21 (the right end in FIG. 1). Therefore, the distance between the point on which the force Fa acts and the point on which the force Fb acts is maximized. In other words, distance between fulcrums on the piston 21 is maximized. As a result, the pressing forces resulting from the component f2 is minimized.

The cavities 34 reduces the weight of the piston 21. This reduces the inertial force of the piston 21 generated when the piston 21 shifts from the suction stroke to the compression stroke. Accordingly, the lateral forces Fa and Fb, which act on the head 21*a* of the piston 21 are reduced.

The low friction layer 39, which is formed on the pressure receiving surfaces 36, reduces frictional resistance between the cylinder bore 12*a* and the piston 21. As a result, the pistons 21 are smoothly reciprocated in the cylinder bores 12*a*.

The piston ring 38 is attached to each piston 21 at the seal 35. Therefore, the width W1 of the seal 35 may be shortened while improving the sealing effectiveness between the seal 35 and the cylinder bore 12*a*. The shortened width W1 reduces the weight of each piston 21. The inertial force of the piston 21 is decreased, accordingly. The decreased inertial force results in decreased lateral forces Fa, Fb acting on the pistons 21.

A second embodiment according to the present invention will now be described. Parts differing from the first embodiment will now be described in detail.

Figure 4:
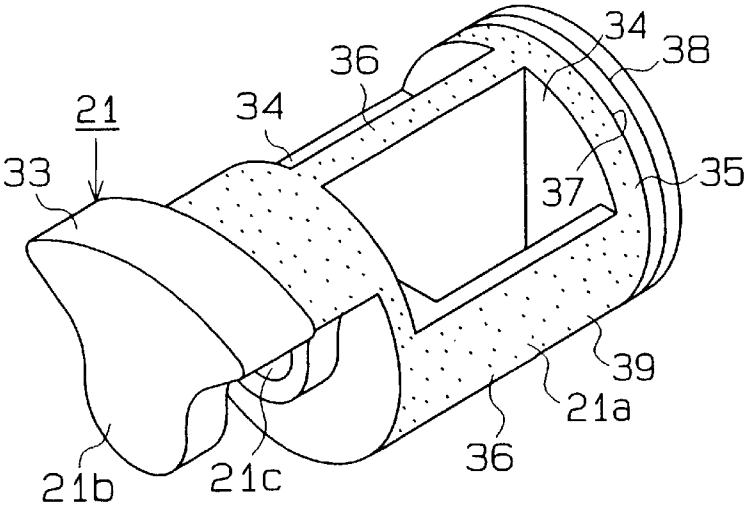
FIG. 4 is a perspective view illustrating a piston of a compressor according to a second embodiment of the present invention.

As shown in FIG. 4, a pair of symmetrical cavities 34 are formed on the head 21*a* of the piston 21 and are located opposite to each other. The cavities 34 are also located on opposite sides of a plane that includes the piston axis C1 and the shaft axis Co. The cavities 34 define a narrow pressure receiving surface 36 at a part corresponding to the outer side of the piston 21. As in the first embodiment, the low friction layer 39 is formed on the pressure receiving surface 36.

Therefore, as in the first embodiment, the weight of the piston 21 is reduced and the lateral force Fa and Fb acting on the head 21*a* is decreased. Also, the low friction layer 39 smoothes the reciprocation of the pistons 21 in the cylinder bores 12*a*.

A third embodiment according to the present invention will now be described. Parts differing from the first embodiment will now be described in detail.

Figure 5:
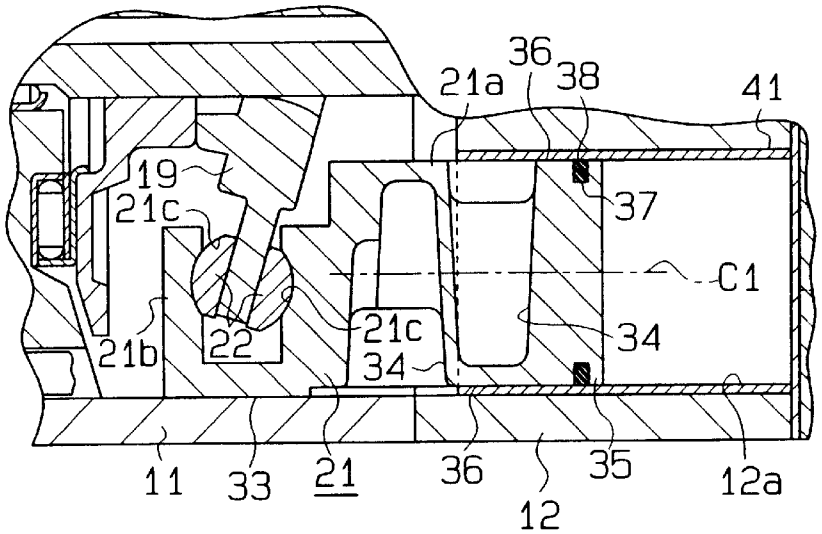
FIG. 5 is an enlarged partial cross-sectional view illustrating a variable displacement compressor according to a third embodiment of the present invention.
Figure 7:
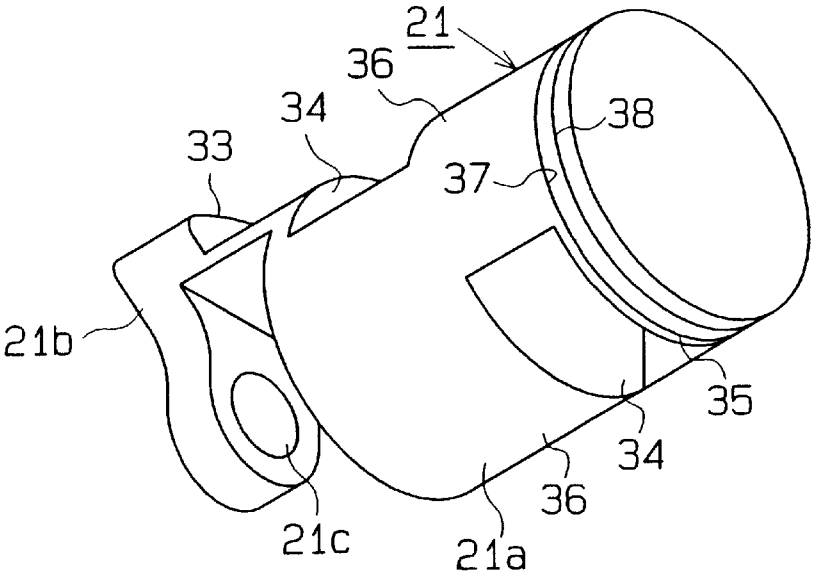
FIG. 7 is a perspective view of the piston of FIG. 6 viewed from a different direction.
Figure 6:
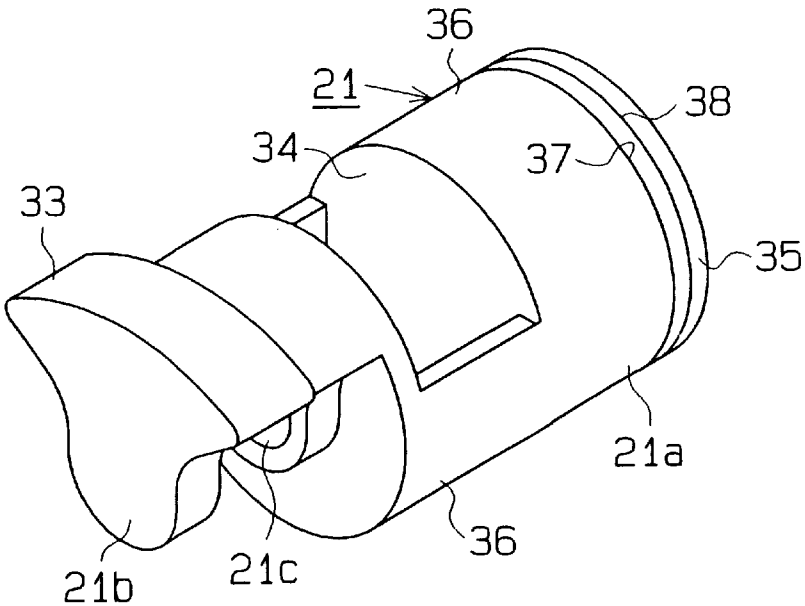
FIG. 6 is a perspective view illustrating a piston of the compressor shown in FIG. 5.

As shown in FIGS. 5–7, a pair of cavities 34 are formed in the piston head 21*a*. The cavities 34 are angularly spaced apart by 180 degrees about the axis of the piston 21 and are arranged at different axial positions. Unlike the embodiment of FIGS. 1–4, the low frictional layer 39 is not formed on the pressure receiving surface 36 of the piston head 21*a* of FIG. 6.

A cylinder 41 is press fitted in each cylinder bore 12*a*. The cylinder 41 is made of relatively hard metal such as iron. When the piston 21 is reciprocating, the seal 35 and the pressure receiving surface 36 of piston head 21*a* contact the cylinder 41. In other words, the wall of the cylinder bores 12*a* are covered by the cylinder 41. This prevents the pistons 21 from contacting the wall of the cylinder bore 12*a*, which is made of the same material (aluminum alloy) as the pistons 21.

Therefore, the third embodiment has the same advantages as the first and second embodiments.

Since the pressure receiving surface 36 of the piston and the cylinder 41 are made of different metal, the pistons 21 are smoothly reciprocated even if the temperature of the piston 21 and the cylinder 41 is increased by friction.

The cylinder 41 is simply press fitted in each cylinder bore 12*a*. This facilitates reduction of frictional resistance between the pressure receiving surface 36 and the cylinder bore 12*a*.

The present invention may be embodied in the following forms. The following embodiments have substantially the same advantages as the first to third embodiments.

(1) Alloy plating may be formed on the pressure receiving surface 36 and on the wall of the cylinder bores 12*a* or on the inner wall of the cylinders 41 for reducing frictional resistance of the piston 21. In this case, the plating may be formed with an alloy such as nickel and phosphorus, nickel and boron or cobalt, phosphorus and tungsten.

(2) Instead of the low friction layer 39, the pressure receiving surface 36, the wall of the cylinder bore 12*a* or of the cylinder 41 may be covered with dispersion coating. The metal matrix of the dispersion coating may be selected from metals such as nickel, cobalt, iron, silver, spelter, nickel phosphorus alloy, nickel boron ally and cobalt boron alloy. The material for dispersed particles may be selected from molybdenum disulfide, tungsten disulfide, graphite, graphite fluoride, polytetrafluoroethylene, fluorocarbon resin, calcium fluoride, boron nitride, silicon carbide, polyvinyl chloride and barium sulfate.

(3) The pressure receiving surface 36 or the wall of the cylinder bore 12*a* may be subjected to anodizing for reducing frictional resistance.

(4) The pressure receiving surface 36, the wall of the cylinder bore 12*a* or of the cylinder 41 may be coated, for example, with molybdenum disulfide or tungsten disulfide for reducing frictional resistance.

(5) The inner wall of the cylinder 41 may be coated, for example, with fluorocarbon resin for reducing frictional resistance.

(6) The present invention may be embodied in double-headed piston type compressors.

(7) The present invention may be embodied in a compressor having fixed displacement.

Therefore, the present examples and embodiments are to be considered as illustrative and not restrictive and the invention is not to be limited to the details give herein but may be but may be modified within the scope and equivalence of the appended claims.

What is claimed is:

1. A compressor comprising:

a housing having a bore;

a compression chamber defined within the bore; and a piston that moves within the bore from a bottom dead center position to a top dead center position to compress gas in the compression chamber, wherein the piston seals the compression chamber, the piston including:

a peripheral surface, wherein the peripheral surface has a first surface to form a compression chamber seal and a second surface to receive a lateral reaction force caused by operation of the compressor, wherein at least one specific location on the peripheral surface of the piston receives a significant lateral force due to the operation of the compressor at the bottom dead center position, and wherein the second surface includes the specific location;

a cavity for reducing the weight of the piston, the cavity being spaced apart from the specific location; and an element for smoothing the movement of the piston, the smoothing element being located between the second surface of the piston and the bore.

2. The compressor as set forth in claim 1, wherein the smoothing element includes a layer of a material having a relatively low coefficient of friction.

3. The compressor as set forth in claim 2, wherein the layer is joined to the second surface of the piston.

4. The compressor as set forth in claim 2, wherein the layer is joined to the inner wall of the bore.

5. The compressor as set forth in claim 4, wherein the layer includes a metallic sleeve fitted in the cylinder bore.

6. The compressor as set forth in claim 1, wherein the cavity is a first cavity, and wherein the piston has a second cavity located on an opposite side of the piston to the first cavity.

7. The compressor as set forth in claim 6, wherein the first cavity and second cavity are angularly separated by 180° about the axis of the piston.

8. The compressor as set forth in claim 1, wherein the first surface is formed at an end of the piston that is adjacent to the compression chamber.

9. The compressor as set forth in claim 8, further comprising a piston ring located around the first surface.

10. The compressor as set forth in claim 1, wherein the cavity opens to the peripheral surface of the piston.

11. The compressor according to claim 1, wherein the piston is driven by a drive shaft that is located centrally in the compressor, and wherein the specific location is on a side of the piston that faces generally away from the drive shaft and is axially located approximately midway along the length of the piston.

12. The compressor according to claim 1, wherein the specific location is on a side of the piston that faces generally toward the drive shaft and is axially located at the end of the piston that is adjacent to the compression chamber.

13. A compressor comprising:

a housing having a bore;

a compression chamber defined within the bore; and a piston that moves within the bore from a bottom dead center position to a top dead center position to compress gas in the compression chamber, wherein the piston seals the compression chamber, the piston including:

a cavity for reducing the weight of the piston;

a peripheral surface, wherein the peripheral surface has a first surface to form a compression chamber seal, the first surface being located at an end of the piston that is adjacent to the compression chamber; and a second surface to receive a lateral reaction force caused by operation of the compressor, wherein at least one specific location on the peripheral surface of the piston receives a significant lateral force due to the operation of the compressor at the bottom dead center position, wherein the second surface includes the specific location and the cavity is spaced apart from the specific location; and an element for smoothing the movement of the piston, the smoothing element being located between the second surface of the piston and the bore.

14. The compressor as set forth in claim 13, wherein the cavity opens to the peripheral surface of the piston.

15. The compressor as set forth in claim 14, wherein the smoothing element includes a layer of a material having a relatively low coefficient of friction.

16. The compressor as set forth in claim 15, wherein the layer is joined to the second surface of the piston.

17. The compressor as set forth in claim 15, wherein the layer is joined to the inner wall of the bore.

18. The compressor as set forth in claim 17, wherein the layer includes a metallic sleeve fitted in the cylinder bore.

19. The compressor as set forth in claim 14, wherein the cavity is a first cavity, and wherein the piston has a second cavity located on an opposite side of the piston to the first cavity.

20. The compressor as set forth in claim 19, wherein the first cavity and second cavity are angularly separated by 180° about the axis of the piston.

21. The compressor as set forth in claim 14, wherein the first surface is formed at an end of the piston that is adjacent to the compression chamber.

22. The compressor as set forth in claim 21, further comprising a piston ring located around the first surface.

23. A compressor comprising:

a housing having a bore;

a compression chamber defined within the bore; and a piston that moves within the bore to compress gas in the compression chamber, wherein the piston seals the compression chamber, the piston including:

a peripheral surface, wherein the peripheral surface has a first surface to form a compression chamber seal and a second surface to receive a lateral reaction force caused by operation of the compressor;

a cavity for reducing the weight of the piston, the cavity opening to the peripheral surface of the piston; and an element for smoothing the movement of the piston, the smoothing element being located between the second surface of the piston and the bore.

* * * * *